US006473946B1

(12) United States Patent
Cheng

(10) Patent No.: US 6,473,946 B1
(45) Date of Patent: Nov. 5, 2002

(54) MAGNETIC CLASP

(76) Inventor: Ching-Hsiung Cheng, No. 45, Alley 21, Lane 373, Sec. 3, Chang Shi St., An Nan Dist., Tainan (TW)

( * ) Notice: Subject to any disclaimer, the term of this patent is extended or adjusted under 35 U.S.C. 154(b) by 0 days.

(21) Appl. No.: 09/972,987

(22) Filed: Oct. 10, 2001

(51) Int. Cl.[7] ..... A44B 21/00
(52) U.S. Cl. ..... 24/303
(58) Field of Search ..... 24/303, 66.1; 292/251.5; 248/206.5; 335/285, 303, 304

(56) References Cited

U.S. PATENT DOCUMENTS 3,041,697 A * 7/1962 Budreck ..... 24/303
4,310,188 A * 1/1982 Aoki ..... 292/251.5
4,427,960 A * 1/1984 Wuerfel ..... 335/285
5,987,715 A * 11/1999 Khon ..... 24/303

FOREIGN PATENT DOCUMENTS

JP 11-56183 * 3/1999

* cited by examiner

*Primary Examiner*—James R. Brittain
(74) *Attorney, Agent, or Firm*—Rosenberg, Klein & Lee

(57) ABSTRACT

A magnetic clasp is composed of a bolting member and a locking member, the bolting member including a container, a bolting rod, a first magnetic element, and a second magnetic element; a through hole in the container, both ends of the bolting rod in different outer diameters; the bolting rod, both magnetic elements being received in sequence in the container, the smaller end of the bolting rod penetrating the through hole of the container and its larger end being restricted inside the container and holding against the first magnetic element; both magnetic elements rejecting each other due to opposite magnetism; a through hole in the locking member; the bolting rod penetrating the through hole of the locking member to lock up as the locking member being attracted by the first magnetic element.

4 Claims, 9 Drawing Sheets

MAGNETIC CLASP

BACKGROUND OF THE INVENTION (a) Field of the Invention

The present invention relates to a magnetic clasp, and more particularly to one comprising two magnetic elements having the same magnetism to allow insertion of a shank to one magnetic element to buckle up, and to release by pressing the shank.

(b) Description of the Prior Art

A magnetic clasp of a prior art as illustrated in FIG. 9 is usually composed of a locking base (5) and a bolting plate (6). Said locking base (5) includes a disk casing (51), a ring magnet (52) and another bolting plate (53). A through hole (511) is provided at the center of the casing (51), which at its bottom circumference protruding a plurality of fixation claws (512) and another through hole (521) is provided at the center of the ring magnet (52). Both bolting plates (53) and (6) share the similar (or identical) structure, having on one side provided with a nipple (531) or (61) and the other side two fixation wings (532) or (62). When assembled as illustrated in FIG. 10, the ring magnet (52) is accommodated inside the casing (51), and the bolting plate (53) with its nipple (531) to penetrate the through hole (521) of the ring magnet (52) is also accommodated inside the casing (51). The fixation claws (512) then are folded to fix the bolting plate (53) on the bottom of the casing (51) while the locking base (5) is fixed into a bag (3) with the fixation wings (532), and the bolting plate (6) is also fixed to a flap (4) of the bag (3) with the fixation wings (62). Consequently, the bolting plate (6) has its nipple (61) to penetrate the through holes (511) and (521) of the casing (51) and the ring magnet (52) for the ring magnet (52) to attract the bolting plate (6) and its nipple (61), thus for the flap (4) to lock to the bag (3) to prevent pocket-picker by lifting the flap (4) of the bag (3) from its either side. However, the magnetism of the ring magnet (52) is not strong enough to prevent the flap (4) from being lifted since the bag (3) under normal condition should not prevent easy lift by its lawful owner. If the magnetism is strong enough, the owner of the bag (3) has to practically rip off the flap (4) each time and that is not only consuming a lot of effort but also damaging the flap (4).

SUMMARY OF THE INVENTION

The primary purpose of the present invention is to provide a magnetic clasp including a bolting member and a locking member. Said bolting member includes a container, a bolting rod, a first magnetic element and a second magnetic element. A through hole is provided in the container, and the bolting rod has its one end in larger diameter and the other end in smaller diameter. The bolting rod, the first and the second magnetic elements are received in sequence by the container with the smaller end of the bolting rod penetrating the through hole in the container and the larger end of the bolting rod being restricted inside the container and holding against the first magnetic element. Both of said first and second magnetic elements for sharing the opposite magnetic poles reject against each other, and the first magnetic element holds against the bolting rod. The locking member is provided with a through hole to receive the insertion by the bolting rod to have the first magnetic element attracted to the locking member so to lock up the object fastened to the locking member to prevent any unauthorized lift from either side of the object.

Another purpose of the present invention is to provide a magnetic clasp. Wherein, the outer diameter of the larger end of the bolting rod merely permits it to penetrate the through hole of the locking member while the outer diameter of the smaller end of the bolting rod is smaller than that of the through hole of the locking member. Therefore, the bolting rod under normal condition has its larger end penetrating the through hole of the locking member to prevent the locking member from being lifted from either side. Once the bolting rod is pressed to retreat into the container, the bolting rod while pushing the first magnetic element to clear away the locking member, has its smaller end to be received by the through hole of the locking member to allow easy lift of the locking member away from the bolting rod when the locking member is released.

Another purpose yet of the present invention is to provide a magnetic clasp, wherein, the bolting rod relates to a shank having its one end fixed to a plate and both ends of the shank are in different diameters. The bolting rod has its shank to penetrate the through hole of the container and has its plate to be restricted inside the container. The outer diameter of the larger end of the shank of the bolting rod is merely allows it penetrate the through hole of the locking member and that of the smaller end is smaller than that of the through hole of the locking member. As a result, the plate of the bolting rod is restricted inside the container, also by the first magnetic element for easy operation.

Another purpose yet of the present invention is to provide a magnetic clasp, wherein, the bolting rod relates to a shank with one end fixed to a plate. The outer diameter of the shank merely permits the shank to penetrate the through hole of the locking member while the shank is her extending to for a graded nipple having its outer diameter smaller than that of the through hole of the locking member. Once the locking member is released, the nipple retreats into the through hole of the locking member for a precise identification that the locking member has been easily lifted to offer an even convenient operation

DETAILED DESCRIPTION OF THE PREFERRED EMBODIMENTS

Figure 1:
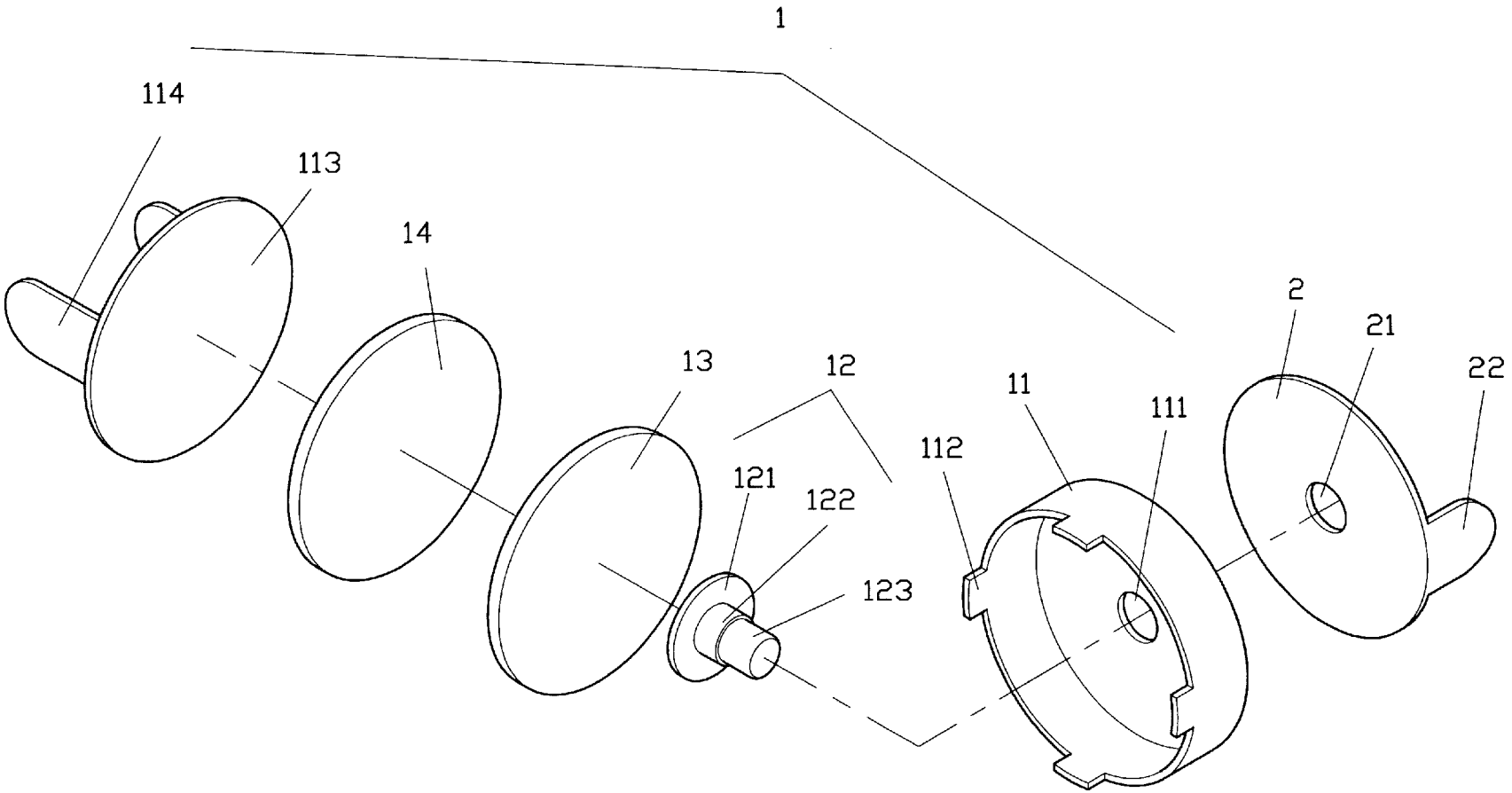
FIG. 1 is an exploded view of a first preferred embodiment of the present invention.
Figure 2:
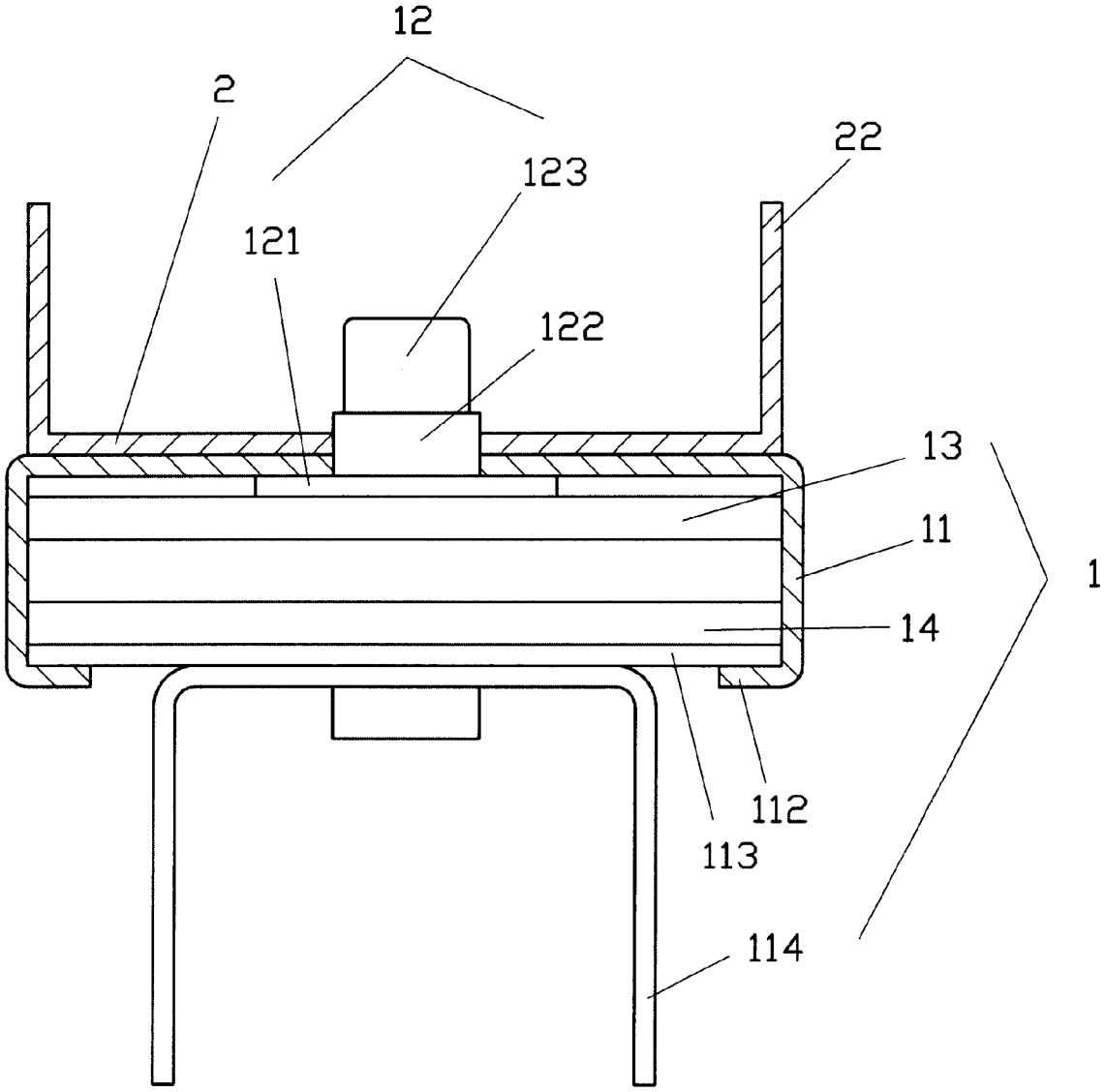
FIG. 2 is a sectional view of an assembly of the first preferred embodiment of the present invention.

Referring to FIGS. 1 and 2, a first preferred embodiment of the present invention includes a bolting member (1) and a locking member (2). The bolting member (1) includes a container (11), a bolting rod (12), a first magnetic element (13) and a second magnetic element (14). The locking member (2) is provided with a through hole (21) and a plurality of fixation tabs (22) extending from the bottom of the locking member (2) to facilitate the locking member (2) to attach to an object (e.g. a bag).

Said container (11) related to a disk casing made of non-magnet inductive material has provided a through hole (111) at its center and a plurality of fixation claws (112) extending from the bottom edge of the container (11) to grasp a base plate (13) having a plurality of fixation tabs (114) to facilitate fixing to an object (e.g., a bag).

Said bolting rod (12) made of non-magnet inductive material provides a shank (122) with on end fixed to a plate (121). A nipple (123) extends from the shank (122). The shank (122) penetrates the throughhole (111) of the container (11) and is restricted with its plate (121) inside the container ( 1). The outer diameter of the shank (122) merely permits it to penetrate the through hole (21) of the locking member (2) while the outer diameter of the nipple (123) is smaller than that of the through hole (21) of the locking member (2).

Both of the first and the second magnetic elements (13) and (14) are made of magnetic material while the locking member (2) is made of material that can be attracted by magnetism.

The bolting rod (12), the first magnetic element (13) and the second magnetic element (14) are received in sequence inside the container (11). As the first and the second magnetic elements (13) and (14) reject each other due to opposite magnetism so to allow the first magnetic element (13) push against the plate (121) of the bolting rod (12).

Figure 3:
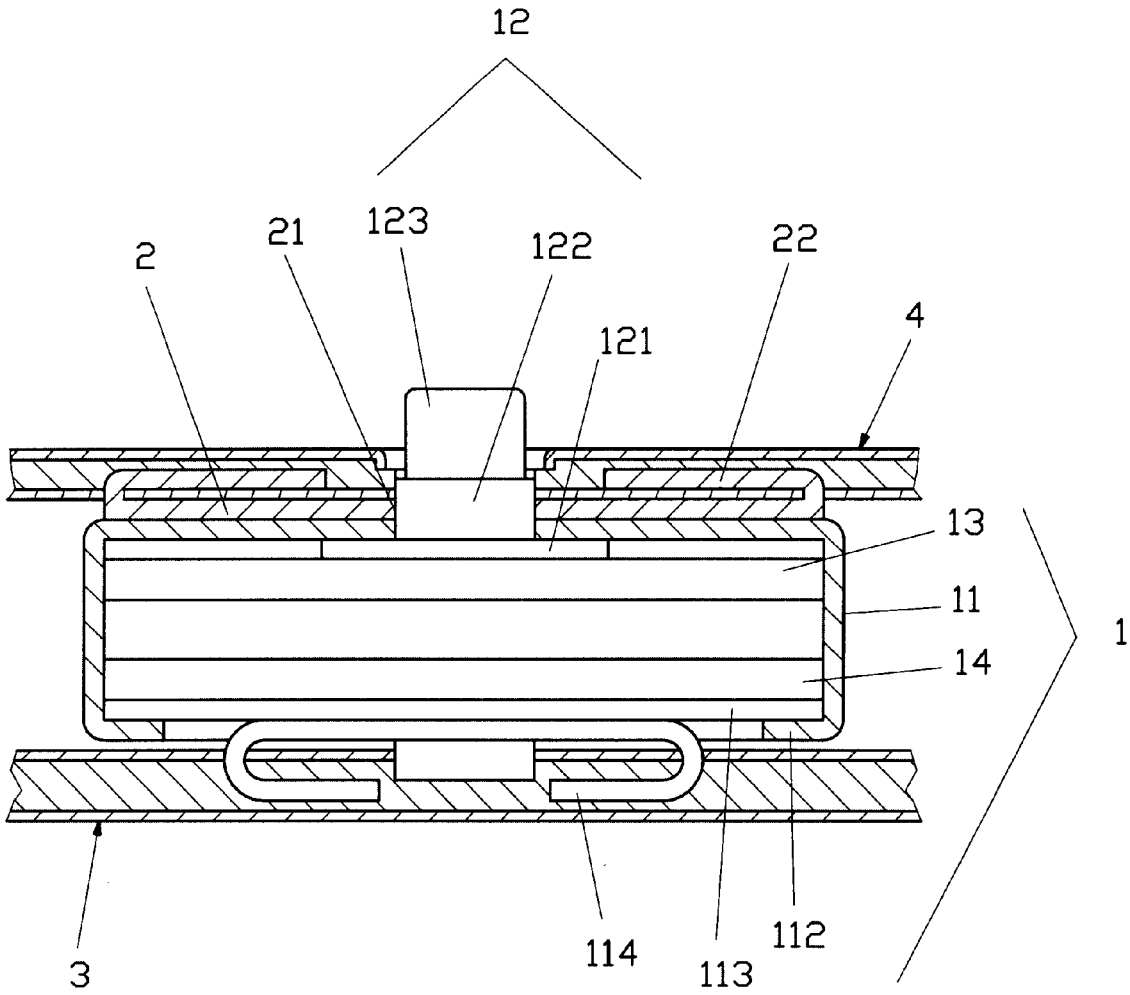
FIG. 3 is a schematic view showing that the assembly of the first preferred embodiment of the present invention is applied to an object, e.g. a bag.

As illustrated in FIG. 3, an assembly of the first preferred embodiment is applied to an object (e.g. a bag). The bolting member (1) is fixed to a bag (3) with the fixation tabs (114) and the locking member (2) is also fixed to a flap (4) of the bag (3) with the fixation tabs (22). The shank (122) of the bolting rod (12) of the bolting member (1) penetrates the through hole (21) of the locking member (2) while the first magnetic element (13) attracts the locking member (2). As the outer diameter of the shank (122) permits the shank (122) to penetrate the through hole (21), the locking member (2) is tightly secured to the bolting member (1) to prevent the flap (4) from being lifted from either side by anyone but the lawful owner of the bag.

Figure 4:
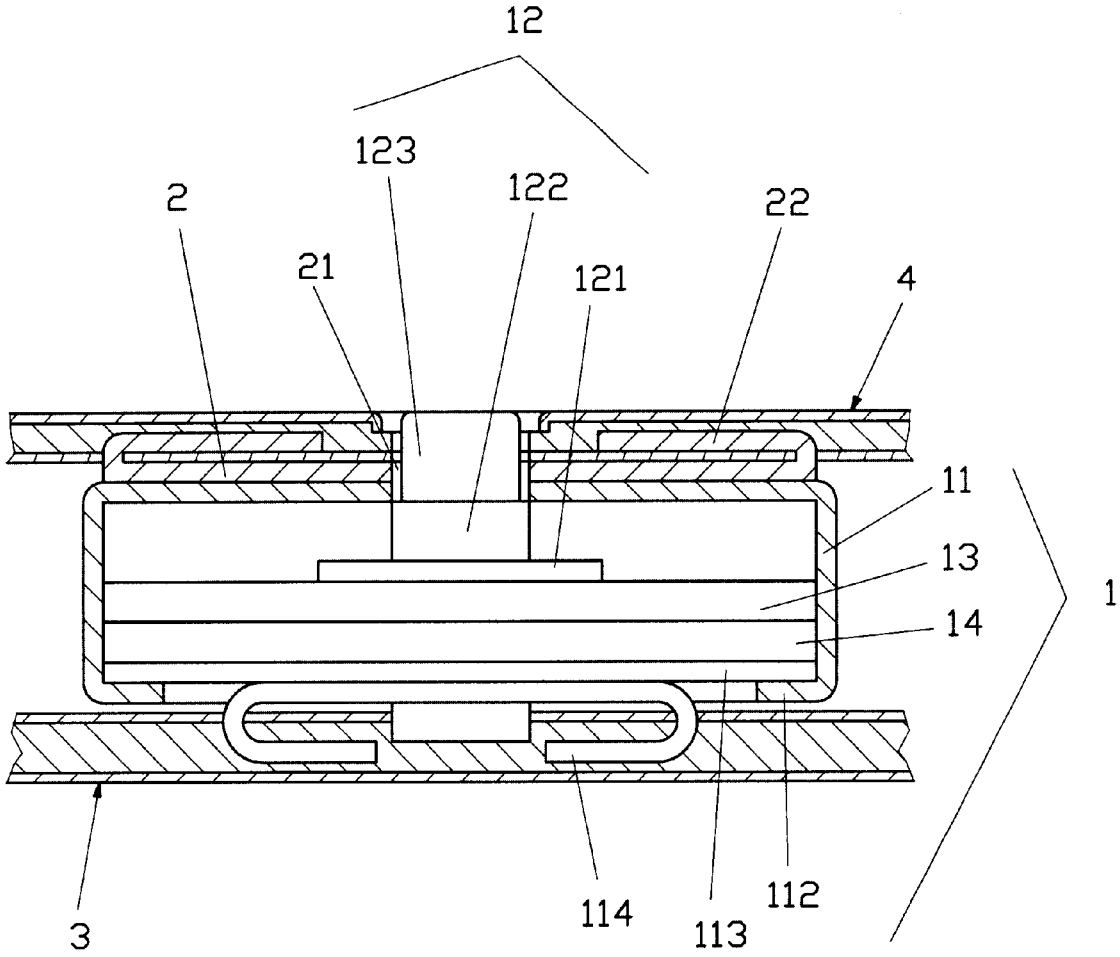
FIG. 4 is a schematic view showing the operation of the first preferred embodiment of the present invention (with the bolting rod pressed)
Figure 5:
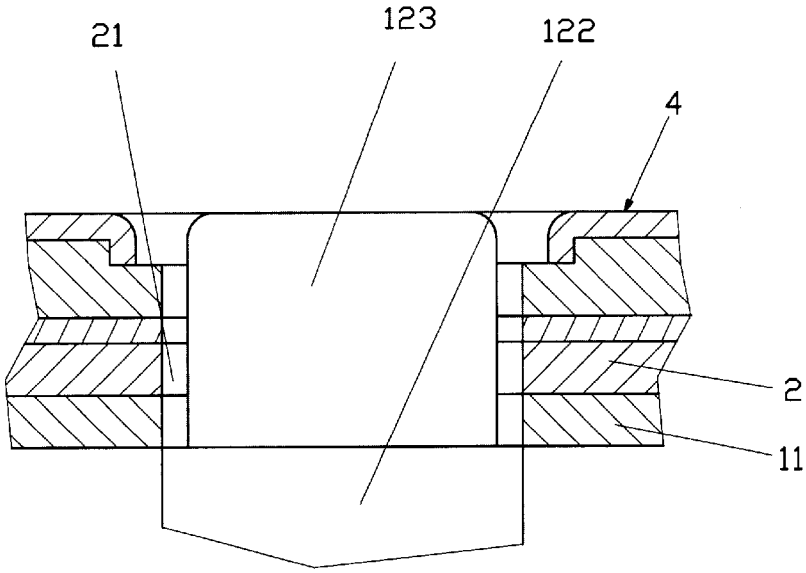
FIG. 5 is a local blowout view taken from FIG. 4.
Figure 6:
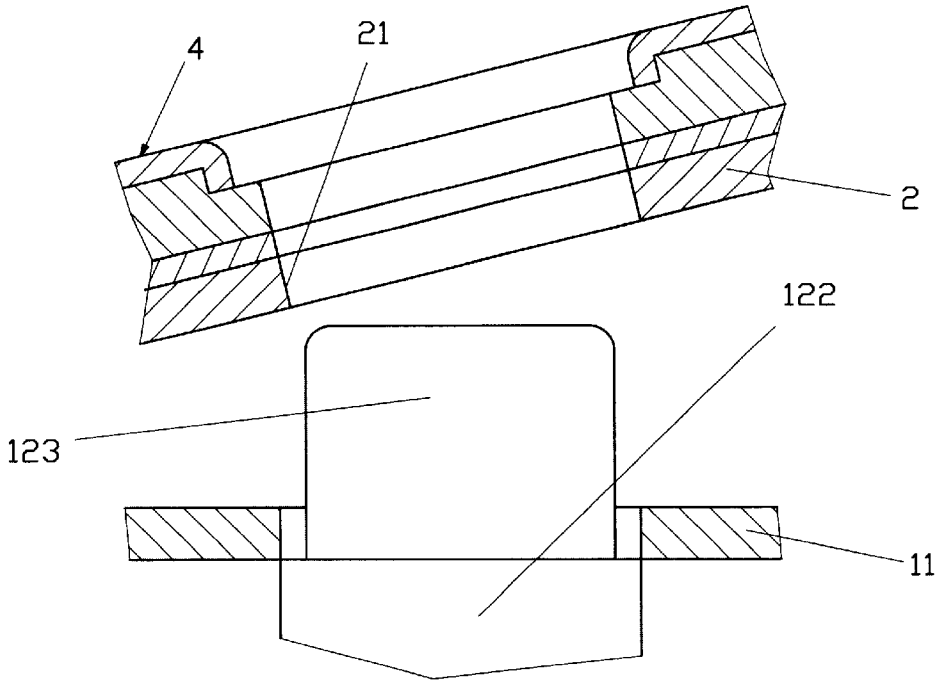
FIG. 6 is another schematic view showing the operation of the first preferred embodiment of the present invention (with the flap of the bag lifted up)
Figure 7:
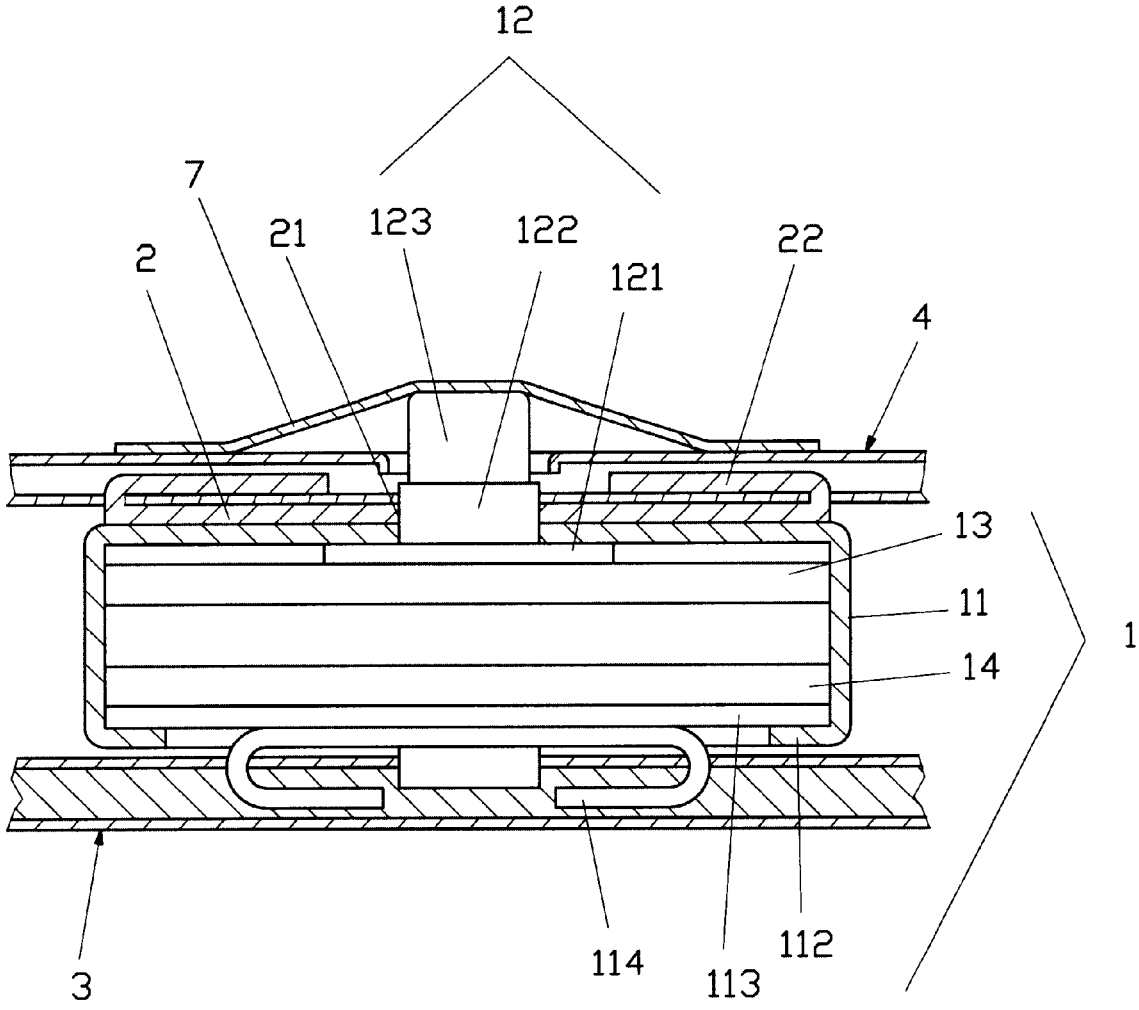
FIG. 7 is a view showing that the first preferred embodiment of the present invention is applied to another object with its flap decorated with a finish layer to cover up the bolting rod, i.e. a hidden magnetic bolt.

To open up the flap (4), as illustrated in FIGS. 4, 5 and 6, the nipple (123) is pressed to retreat both of the shank (122) and the first magnetic element (13) into the container (11), and the nipple (122) into the through hole (21). Since the first magnetic element (13) has already cleared away the locking member (2), the locking member (2) when released can be easily lifted away from the bolting rod (122). The owner is able to easily lift up the flap (4) away from the bag (3) without having to practically rip off the flap (4) and damaging the flap (4), As illustrated in FIG. 7, in the preferred embodiment of the present invention, the flap (4). is decorated with a flexible finish layer (7). Of course, in practice, the finish layer (7) may protrude from the flap (4) at a lever slightly higher than the surface of the flap (4). Upon pressing the finish layer (7), the bolting rod (12) of the bolting member (1) is also pressed. The bolting rod (12) is covered up by the finish layer (7) to further prevent unauthorized lift of the flap (4).

Figure 8:
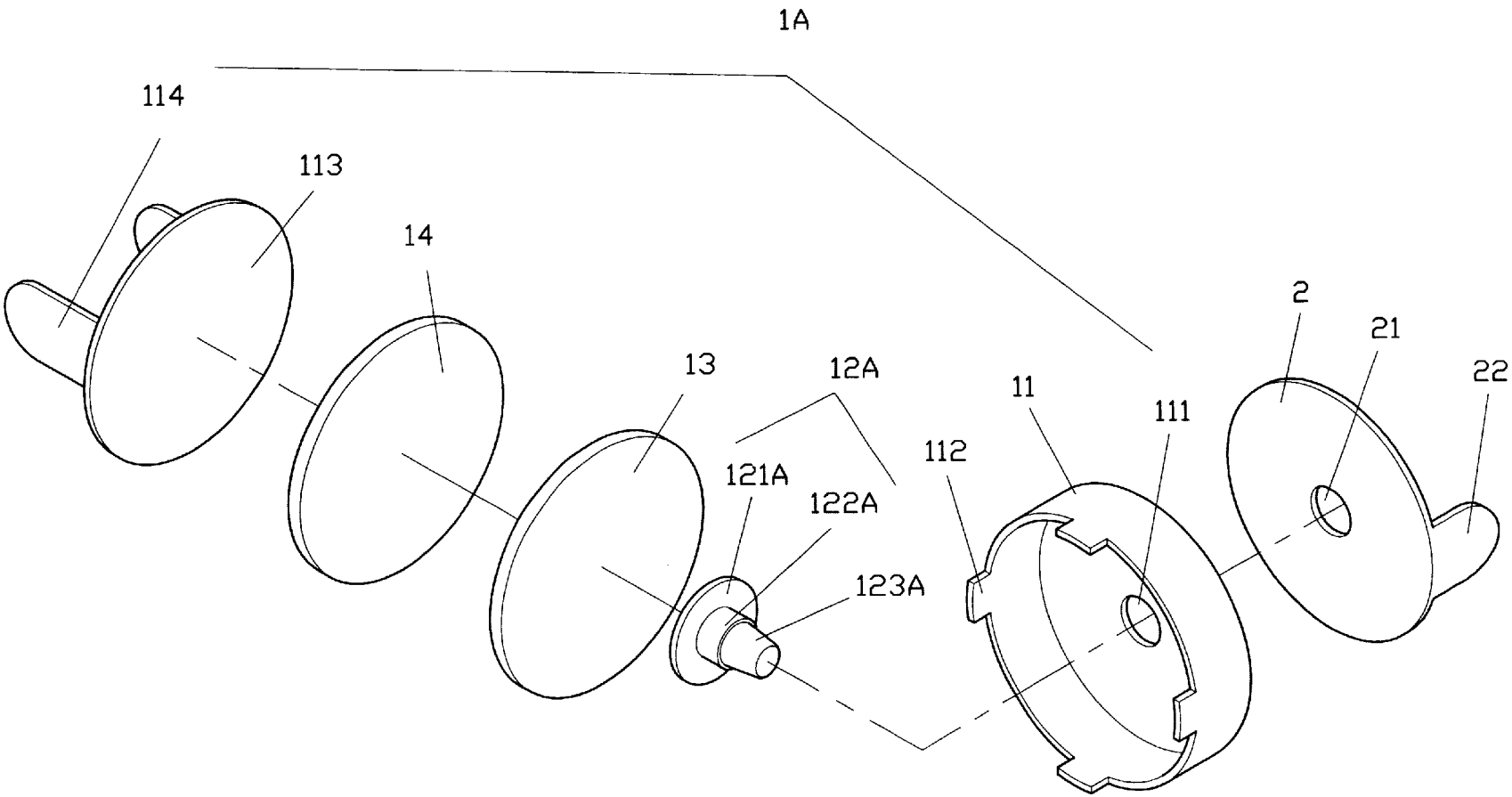
FIG. 8 is an exploded view of a second preferred embodiment of the present invention with the nipple of the bolting rod indicating a knapsack shape.
Figure 9:
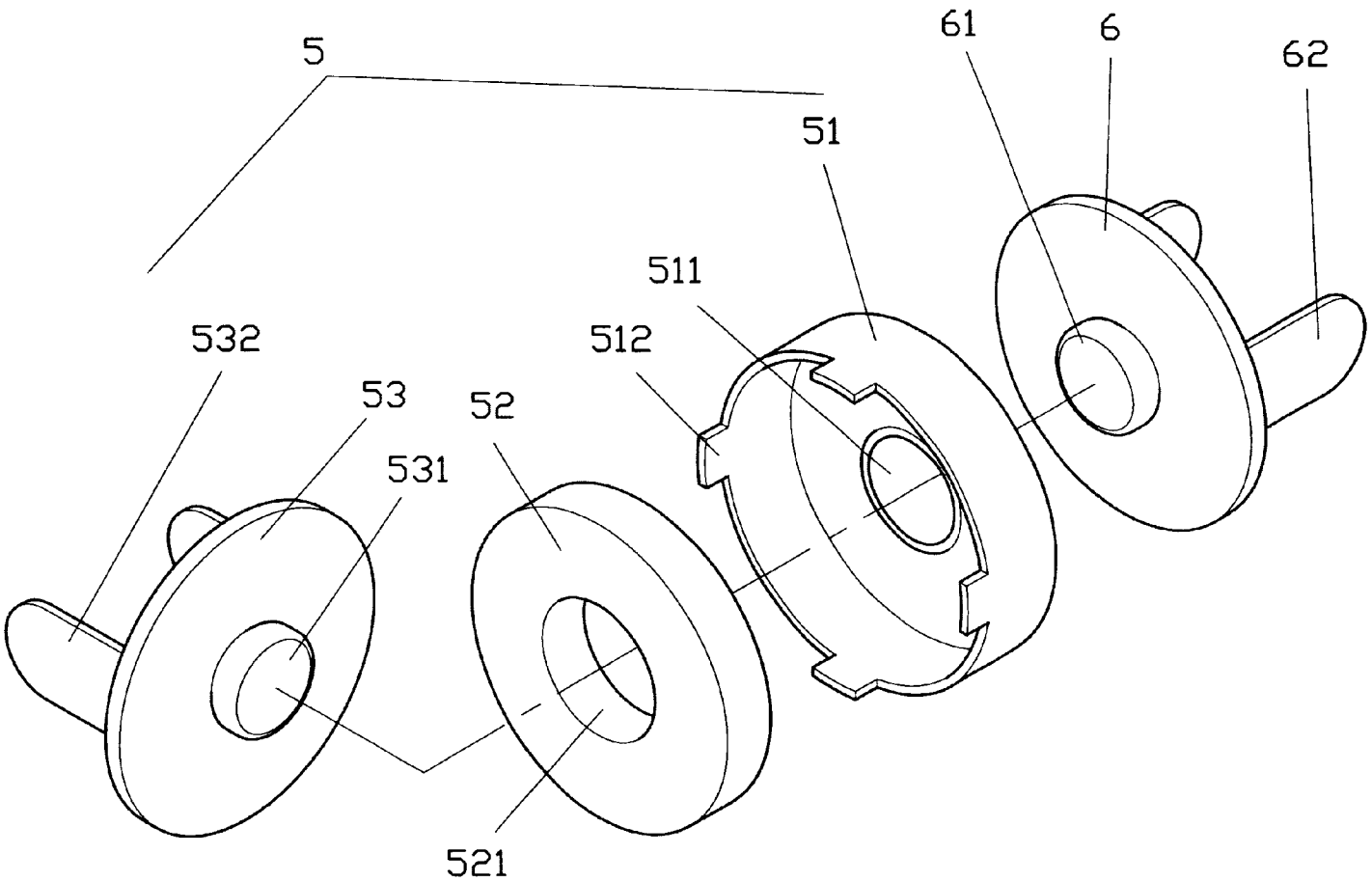
FIG. 9 (PRIOR ART)
FIG. 9 is an exploded view of a prior art.
Figure 10:
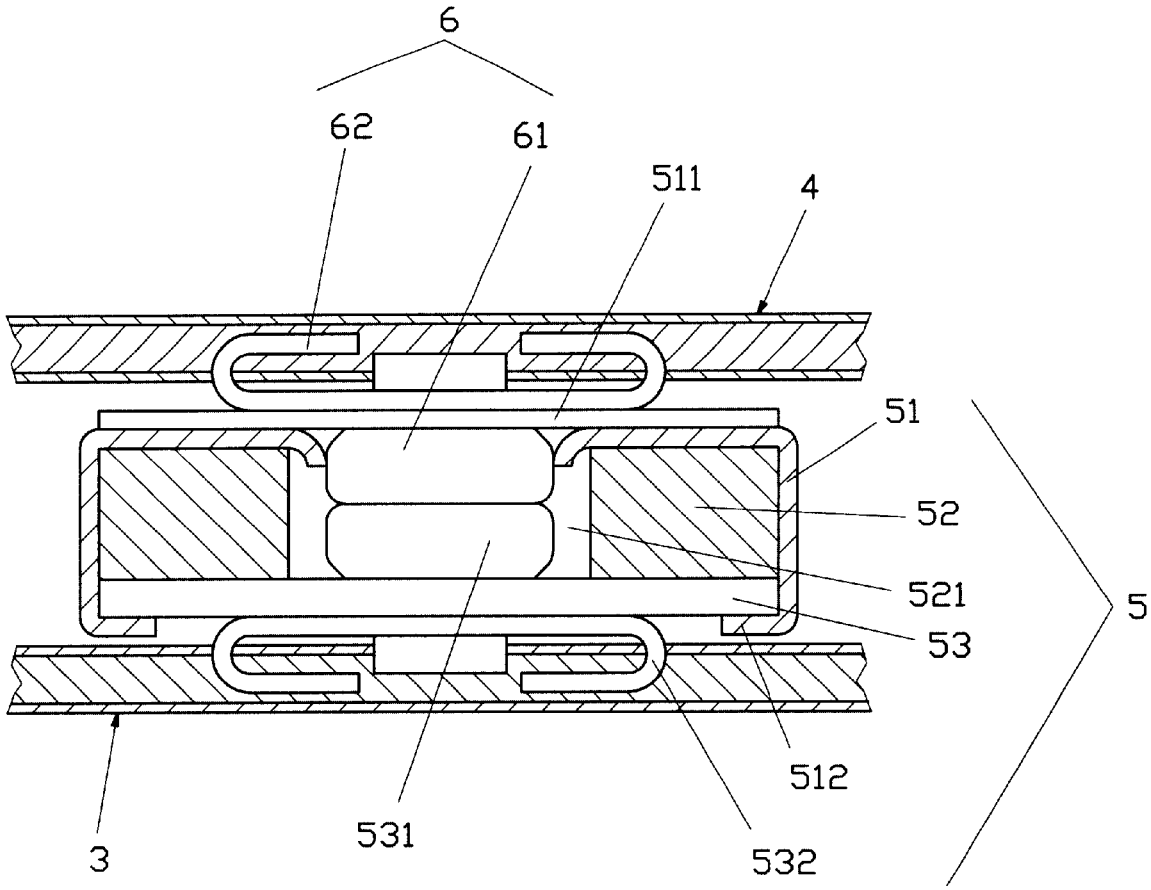
FIG. 10 (PRIOR ART)
FIG. 10 is a sectional view of an assembly of the prior art.

Referring to FIG. 8, a second preferred embodiment of the present invention differs from the first preferred embodiment only in its bolting rod (12A) of a bolting member (1A). The bolting rod (12A) relates to a shank (122A) with one end fixed to a plate (121A) but a nose in a shape of knapsack extends from the shank (122A).

As disclosed above, a magnetic clasp of the present invention when compared to that of the prior art by effectively offering easier operation and preventing the flap to be lifted from either side by a pocket-picker.

I claim:

1. A magnetic clasp comprising a bolting member and a locking member, wherein, the bolting member including a container, a bolting rod, a first magnetic element, and a second magnetic element; a through hole being provided in the container; both ends of the bolting rod having different outer diameters; the bolting rod, the first magnetic element and the second magnetic element being received in sequence in the container; the bolting rod having its smaller end to penetrate the through hole of the container and its larger end being restricted inside the container and holding against the first magnetic element; both of the first and the second magnetic elements rejecting each other due to opposite magnetism; a through hole being provided in the locking member; the bolting rod penetrating the through hole of the locking member and to lock up by having the locking member attracted by the first magnetic element.

2. A magnetic clasp as claimed in claim 1, wherein, the outer diameter of the larger end of the bolting rod merely permit the bolting rod to penetrate the through hole of the locking member and the outer diameter of the smaller end of the bolting rod is smaller than that of the through hole of the locking member.

3. A magnetic clasp as claimed in claim 1, wherein, the bolting rod relates to a shank with its one end fixed to a plate and the bolting rod penetrate the through hole in the container with the shank, then is restricted with the plate inside the container.

4. A magnetic clasp as claimed in claim 3, wherein, a nipple is extending from the shank of the bolting rod in an outer diameter smaller than that of the through hole of the locking member.

* * * * *